US005457954A

United States Patent [19]

Boyd et al.

[11] Patent Number: 5,457,954

[45] Date of Patent: Oct. 17, 1995

[54] ROLLING CONTACT MOUNTING ARRANGEMENT FOR A CERAMIC COMBUSTOR

[76] Inventors: Gary L. Boyd, 328 Sneath Way, Alpine, Calif. 91901; James E. Shaffer, 1780 Geronimo Tr., Maitland, Fla. 32751

[21] Appl. No.: 171,545

[22] Filed: Dec. 21, 1993

[51] Int. Cl.[6] ..... F23R 3/42; F02C 7/20

[52] U.S. Cl. ..... 60/39.32; 60/753

[58] Field of Search ..... 60/753, 39.32, 60/752, 39.34, 39.35; 431/353

[56] References Cited

U.S. PATENT DOCUMENTS 2,526,223 10/1950 Goddard ..... 60/39.35
2,536,599 1/1951 Goddard ..... 60/39.35
2,576,678 11/1951 Goddard ..... 60/39.463
2,590,063 3/1952 Bailey, Jr. ..... 60/39.35

*Primary Examiner*—Timothy S. Thorpe

[57] ABSTRACT

A combustor assembly having a preestablished rate of thermal expansion is mounted within a gas turbine engine housing having a preestablished rate of thermal expansion being greater than the preestablished rate of thermal expansion of the combustor assembly. The combustor assembly is constructed of a inlet end portion, a outlet end portion and a plurality of combustor ring segments positioned between the end portions. A mounting assembly is positioned between the combustor assembly and the gas turbine engine housing to allow for the difference in the rate of thermal expansion while maintaining axially compressive force on the combustor assembly to maintain contact between the separate components.

19 Claims, 3 Drawing Sheets

ROLLING CONTACT MOUNTING ARRANGEMENT FOR A CERAMIC COMBUSTOR

"The Government of the United States of America has rights in this invention pursuant to Contract No. DE-AC02-92CE40960 awarded by the U.S. Department of Energy."

TECHNICAL FIELD

This invention relates generally to a gas turbine engine and more particularly to a mounting arrangement for a combustor made of ceramic.

BACKGROUND ART

In operation of a gas turbine engine, air at atmospheric pressure is initially compressed by a compressor and delivered to a combustion stage. In the combustion stage, heat is added to the air leaving the compressor by adding fuel to the air and burning it. The gas flow resulting from combustion of fuel in the combustion stage then expands through a turbine, delivering up some of its energy to drive the turbine and produce mechanical power.

The gases within the combustor typically range from between 2000 degrees to at least 2500 degrees Fahrenheit. Since the efficiency and work output of the turbine engine are related to the entry temperature of the incoming gases, at the turbine section, there is a trend in gas turbine engine technology to increase the gas temperature. A consequence of this is that the materials of which the combustor, blades and vanes are made assume ever-increasing importance with a view to resisting the effects of elevated temperature.

Combustors historically have been made of metals such as high temperature steels. More recently they are made of nickel alloys. It has been found necessary to provide internal cooling passages in order to prevent melting. Ceramic coating can enhance the heat resistance of the turbine components. In specialized applications, nozzle guide vanes and blades are being made entirely of ceramic, thus, imparting resistance to even higher gas entry temperatures and requiring higher temperatures within the combustor.

However, if the combustor is made of ceramic, which have a different chemical composition, physical property and coefficient of thermal expansion to that of a metal supporting structure, then undesirable stresses, a portion of which are thermal stresses, will be set up between the combustor and its supports when the engine is operating. Such undesirable thermal stresses cannot adequately be contained by cooling.

Furthermore, conventional assembly techniques and methods will require alternative designs, processes and assembly techniques. The structural components of the combustor and the assembly of the combustor within the gas turbine engine will need to be rethought.

Historically, using metallic components, a combustor design has used a multipiece design of segments one overlaps another. The segments are rigidly secured one to another by rivets, bolts and/or welding. As an alternative, the combustor has been formed from a single piece. With a ceramic combustor, the integrity of the material and the construction thereof can drastically increase cost and can result in premature failure due to flaws in the surface. The larger the physical size of the ceramic shape the lesser the likelihood of producing a component having structural integrity. The sliding friction between the ceramic combustor and the supporting structure creates a contact tensile stress on the ceramic that will cause surface deterioration. If this deterioration in the surface of the ceramic occurs in a tensile stress zone of the combustor the generated surface flaw can result in catastrophic failure.

The present invention is directed to overcoming one or more of the problems as set forth above.

DISCLOSURE OF THE INVENTION

In one aspect of the present invention a mounting arrangement for a combustor assembly includes an inlet end portion and an outlet end portion. Means is provided for applying axially compressive force on the combustor assembly.

The present invention provides a combustor assembly arrangement which is constructed of a plurality of segments to expand and contract at a different rate of thermal expansion than the surrounding housing. The arrangement includes a mounting structure positioned between the combustor assembly and the housing. The mounting structure will allow the combustor assembly-to axially expand greater than the housing while maintaining axially compressive force on the combustor assembly to maintain abutting contact between the segments.

BRIEF DESCRIPTION OF THE INVENTION

BEST MODE FOR CARRYING OUT THE INVENTION

Figure 1:
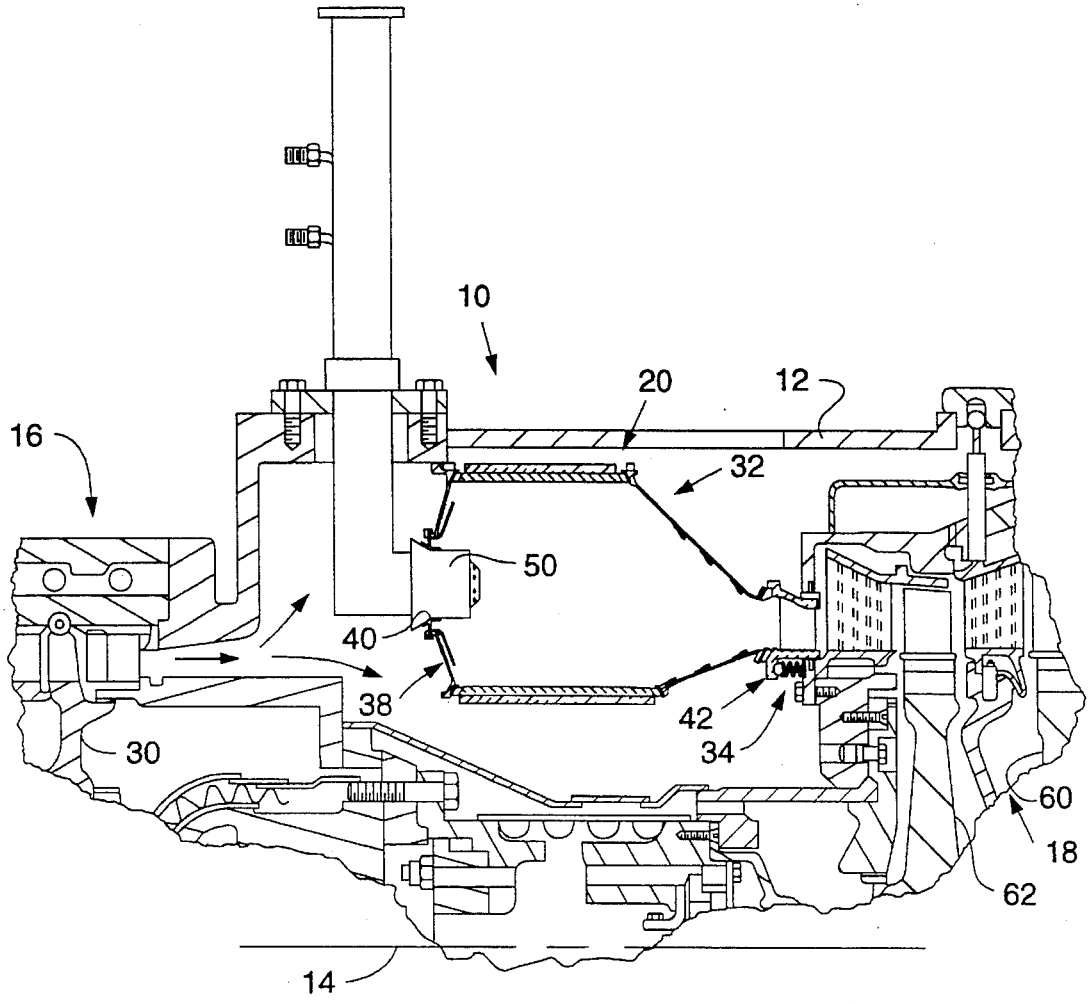
FIG. 1 is a partial side view of a gas turbine engine embodying the present invention with portions shown in section for illustration convenience.

Referring to FIG. 1, a gas turbine engine 10 is shown. The gas turbine engine 10 has an outer housing 12 having a central axis 14. Positioned in the housing 12 and centered about the axis 14 is a compressor section 16, a turbine section 18 and a combustor section 20 positioned operatively between the compressor section 16 and the turbine section 18.

When the engine 10 is in operation, the compressor section 16, which in this application includes an axial staged compressor 30, causes a flow of compressed air which has at least a part thereof communicated to the combustor section 20. The combustor section 20, in this application, includes an annular combustor assembly 32 being supported in the gas turbine engine 10 by an attaching means 34. The combustor assembly 32 has a metallic inlet end portion 38 having a plurality of generally evenly spaced opening 40 therein and a ceramic outlet end portion 42. Each of the openings 40 has an injector nozzle 50 positioned therein. In this application the injector nozzle 50 is of the premix type in which air and fuel are premixed prior to entering the combustor assembly 32.

The turbine section 18 includes a power turbine 60 having an output shaft, not shown, connected thereto for driving an accessary component such as a generator. Another portion of the turbine section 18 includes a gas producer turbine 62 connected in driving relationship to the compressor section 16.

Figure 2:
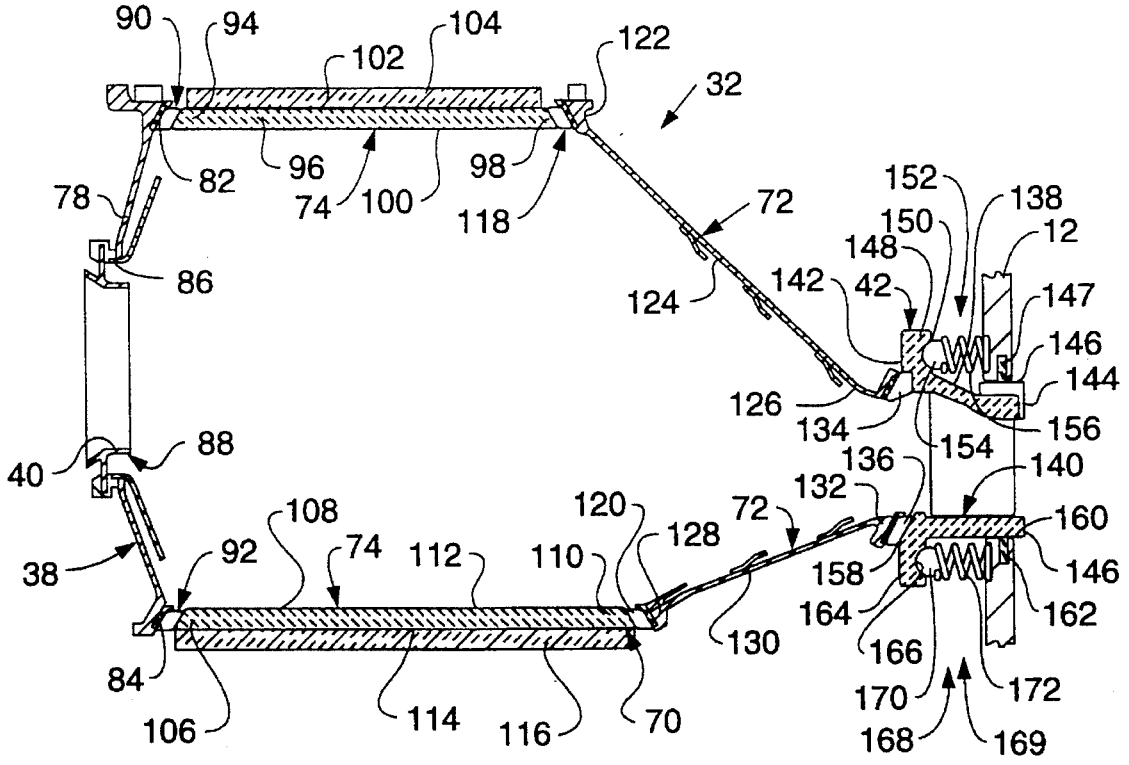
FIG. 2 is an enlarged sectional view of a multipiece combustor.

In this application, as best shown in FIG. 2, the combustor assembly 32 is constructed of a plurality of segments 70 being interposed the metallic inlet end portion 38 and the ceramic outlet end portion 42. As an alternative the combustor could be of a one piece construction. In this application, the plurality of segments 70 include a metallic section 72 and ceramic section 74 made of a reaction bonded or reaction centered material using silicon as a starting powder. The combustor assembly 32 includes a plurality of bearing or seal assemblies positioned between adjacent sections to seal the combustor assembly 32 to prevent leakage of non-vitiated compressor air. The bearing assemblies also prevent surface deterioration during thermal expansion of the sections and provide thermal insulation and isolation of the ceramic section 70 from the metallic section 72. The inlet end portion 38 of the combustor assembly 32 includes an end plate 78 which encloses the inlet side of the combustor assembly 32. The end plate 78 is mounted within the turbine housing 12. The end plate 78 has a first bearing surface 82 and a second bearing surface 84. The end plate 78 also has a plurality of generally evenly spaced opening 86 therein positioned between the bearing surfaces 82, 84. A nozzle receiving insert 88 is positioned within the opening 86 of the end plate 78. The nozzle receiving insert 88 contains the opening 40 which is a sized and positioned to receive the nozzle 50. A first outer bearing assembly 90 is positioned to contact the first bearing surface 82 of the end plate 78. A first inner bearing assembly 92 is positioned to contact the second bearing surface 84 of the end plate 78. Positioned axially adjacent the first outer bearing assembly 90 is a first end potion 94 of a first outer combustor ring 96. The first outer combustor ring 96 includes a second end portion 98 positioned axially opposite the first end portion 96. The first outer combustor ring 96 has a combustor side 100 being spaced from an air side 102. An insulating material 104 is positioned adjacent the air side 102 to contain the heat within the combustor 32. Positioned axially adjacent the second bearing surface 84 is a first end portion 106 of an first inner combustor ring 108. The first inner combustor ring 108 includes a second end portion 110 positioned axially opposite the first end portion 106. In this application the first outer and the first inner combustor rings 96, 108 are constructed of a ceramic material. The first inner combustor ring 108 has a combustor side 112 being spaced from an air side 114. An insulating material 116 is positioned adjacent the air side 114 to contain the heat within the combustor 32. A second outer bearing assembly 118 is axially positioned adjacent the second end portion 98 of the first outer combustor ring 96. A second inner bearing assembly 120 is axially positioned adjacent the second end portion 110 of the first inner combustor ring 108. Positioned axially adjacent the second outer bearing surface 118 is a first end portion 122 of a second outer combustor ring 124. The second outer combustor ring 124 includes a second end portion 126 positioned axially opposite the first end portion 122. Positioned axially adjacent the second inner bearing assembly 120 is a first end portion 128 of a second inner combustor ring 130. The second inner combustor ring 130 includes a second end portion 132 positioned axially opposite the first end portion 128. In this application the second outer and second inner combustor rings 124, 130 are constructed of a metallic material. A third outer bearing assembly 134 is positioned axially adjacent the second end portion 126 of the second outer combustor ring 124. A third inner bearing assembly 136 is positioned axially adjacent the second end portion 132 of the second inner combustor ring 130. The outlet end portion 42 includes a third outer combustor ring 138 and a third inner combustor ring 140. In this application the third outer and the third inner combustor ring 138, 140 are made of ceramic. The third outer combustor ring 138 has a first end portion 142 positioned axially adjacent the third outer bearing assembly 134 and a second end portion 144 slidably positioned within an opening 146 of the turbine housing 12. The turbine housing 12 includes an outer seal ring 147 between the housing 12 and the second end portion 144. The first end portion 142 includes a flange 148 having a spherical indent 150. A means 152 for applying axially compressive force is axially positioned between the flange 148 and the housing 12. The means 152 includes, a ball 154 positioned within the indent 150, and a spring 156 positioned between the ball 154 and the turbine housing 12. The means 152 allows for axial thermal expansion of the combustor assembly 32. The third inner combustor ring 140 has a first end portion 158 positioned axially adjacent the third inner bearing assembly 136 and a second end portion 160 slidably positioned within the opening 146 of the turbine housing 12. The turbine housing 12 includes an inner seal ring 162 between the housing 12 and the second end portion 160. The first end portion 158 includes a flange 164 having a spherical indent 166. A means 168 for applying axially compressive force is axially positioned between the flange 164 and the housing 12. The means 168 includes a mounting assembly 169 having a ball 170 positioned within the indent 166, and a spring 172 positioned between the ball 170 and the turbine housing 12. The means 168 allows for axial thermal expansion of the combustor assembly 32 and provides rolling contact to reduce wear. The bearing assemblies provide rolling contact allowing for varying thermal expansion between the ceramic components and the metallic components by allowing the segments to move relative to each other without surface deterioration.

Figure 3:
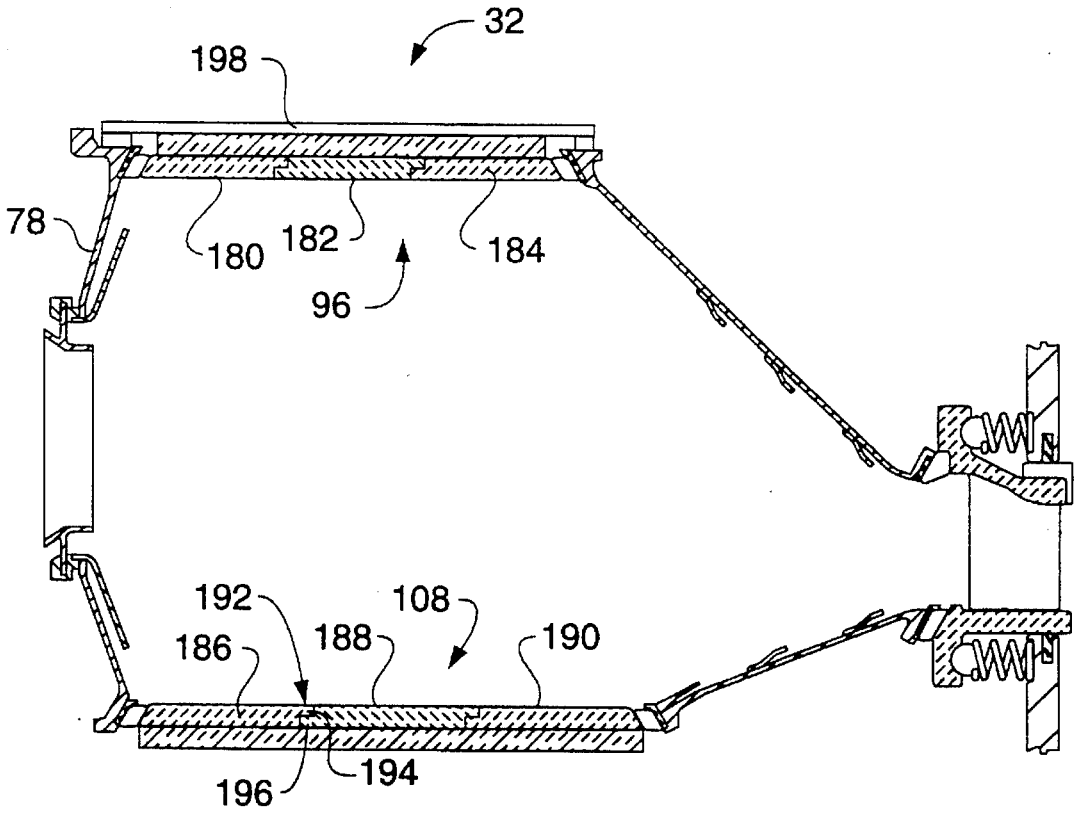
FIG. 3 is an enlarged sectional view showing an alternate segmented ceramic combustor.

An alternate embodiment of a combustor assembly 32 of the present invention is disclosed in FIG. 3. It is noted that the same reference numerals of the first embodiment are used to designate similarly constructed counterpart elements of this embodiment. In this embodiment however, the construction of the combustor assembly 32 is modified by changing the first outer combustor ring 96 from one segment to a plurality of segments 180, 182 and 184. The first inner combustor ring 108 is also modified from having only one segment to having a plurality of segments 186, 188 and 190. The segments 180, 182, 184, 186, 188 and 190 have a plurality of joints 192, which interact to maintain radial alignment of the segments while allowing thermal expansion. All the joints 192 are identical, therefore only one will be described in detail. However, as an alternative each or some of the joints could be of alternate design. The joint 192 includes a first flange 194 extending axially from one segment and a second flange 196 extending axially from another segment in an overlapping arrangement with the first flange 194. A retaining band 198 is circumferentially positioned around the outer combustor ring 96 and the insulation 104. The retaining band 198 will help align the segments 180, 182, 184, 186, 188 and 190, but will allow for radial thermal expansion of the individual segments.

Industrial Applicability

In use, the gas turbine engine 10 is started and allowed to warm up and is used in any suitable power application. As the demand for load or power is increased, the engine 10 output is increased by increasing the fuel and subsequent air resulting in the temperature within the engine 10 increases. The components used to make up the gas turbine engine 10, being of different materials and different rates of thermal expansion, grow at different rates and the forces resulting therefrom and acting thereon must structurally be compensated for to increase life and efficiency of the gas turbine engine. For example, as the fuel and air is injected into the combustor assembly from the injector nozzle 50 the mixture begins to burn. As the burning mixture moves axially along the combustor assembly 32 from the inlet end portion 38 to the outlet end potion 42, the temperature increases to a maximum of about 2500 degrees Fahrenheit. The temperature of the various components each receive a different temperature radian from the inlet end portion 38 to the outlet end portion 42 and therefore expand differently and also expand differently from the turbine housing 12. The radial expansion of the individual rings is generally increasing from the inlet end portion 38 toward the outlet end portion 42. Furthermore, the axial expansion of individual ring members differ in the axial direction due to the difference in thermal temperature and different construction axially along the combustor assembly 32 from the inlet end portion 38 to the outlet end portion 42. Thus, the actual expansion, in both the radial and the axial dimension, of the various components differs one from another. Furthermore, the temperature radian along the axial length of an individual member differs and expands dimensionally differently in the radial direction and the axial direction along the axial length of the individual ring members.

To compensate for the difference in axial expansion, means 152, 168 are provided for rolling contact to allow for the expansion while maintaining compression force to keep the various components in abutting relationship with each other. The means 152, 168 each have a respective ball 154, 170 which is positioned in a respective spherical indent 150, 166. The means 152, 168 each have a respective spring 156, 172 positioned between the ball 154, 170 and the housing 12. As the combustor assembly 32 moves the ball 154, 170 will roll in the spherical indent 150, 166 and the spring 156, 172 to allow for the movement. The rolling action will reduce wear and surface flaws on the components and prevent surface deterioration which could result in catastrophic failure.

In view of the foregoing, it is readily apparent that the structure of the present invention provides an improved combustor assembly 32. The plurality of combustor rings which make up the combustor assembly are made of ceramic and metal and are positioned in an abutting relationship. The plurality of ring and the joints therebetween allow the individual ring to expand and contact axially along the combustor assembly. The combustor assembly will expand axially in respect to the housing 12, therefore a means is provided which will allow for the expansion and still maintain axial compressive force on the combustor assembly. The structural arrangement of the jointed segments and the material provide a combustor assembly 32 in which higher temperatures can be attained while maintaining structural reliability. The increased temperature reduces emissions and increases efficiencies.

Other aspects, objects and advantages of this invention can be obtained from a study of the drawings, the disclosure and the appended claims.

We claim:

1. A combustor adapted for mounting to a housing of a gas turbine engine, comprising:

an inlet end portion and an outlet end portion;

means for applying axially compressive force on the combustor, said means for applying axially compressive force including a means for providing rolling contact, said means for providing being interposed one of the end portions and the housing of the gas turbine engine.

2. The combustor of claim 1, wherein the means for applying axially compressive force is positioned between one of the end portions and the housing.

3. The combustor of claim 1, wherein the means for applying axially compressive force includes a ball.

4. The combustor of claim 1, wherein the means for applying axially compressive force includes a spring.

5. A combustor assembly adapted for mounting to a housing of a gas turbine engine, comprising:

an inlet end portion;

an outlet end portion;

a plurality of segments interposed the inlet end portion and the outlet end portion;

means for applying axially compressive force on the inlet end portion, the outlet end portion and the plurality of segments to allow for axial thermal expansion of the combustor assembly relative to the housing, said means for applying axially compressive force including a means for providing rolling contact, said means for providing being interposed one of the end portions and the housing of the gas turbine engine.

6. The combustor assembly of claim 5, wherein the means for applying axially compressive force is positioned between one of the end portions and the turbine housing.

7. The combustor assembly of claim 5, wherein the means for applying axially compressive force includes a spring.

8. The combustor assembly of claim 5, wherein the plurality of segments includes a portion thereof having a generally cylindrical configuration.

9. The combustor assembly of claim 8, wherein the cylindrical segment is formed of a plurality of ring segments including an end portion having a recessed portion therein.

10. The combustor assembly of claim 5, wherein the plurality of segments includes a portion thereof having a generally conical configuration.

11. The combustor assembly of claim 5 wherein said means for applying axially compressive force is mounted between the combustor assembly and the housing of the gas turbine engine.

12. The combustor assembly of claim 1 wherein said means for providing rolling contact includes an indent positioned in the end portion in which the means for providing is interposed therewith.

13. The combustor assembly of claim 12 wherein said indent has a spherical configuration.

14. The combustor assembly of claim 5 wherein said means for providing rolling contact includes an indent positioned in the end portion in which the means for providing is interposed therewith.

15. The combustor assembly of claim 14 wherein said indent has a spherical configuration.

16. The combustor assembly of claim 1 wherein said means for providing rolling contact prevents surface deterioration as relative movement between the end portion and the gas turbine engine occurs.

17. The combustor assembly of claim 16 wherein said means for providing rolling contact further provides thermal insulation/isolation between the combustor assembly and the gas turbine engine.

18. The combustor assembly of claim 5 wherein said means for providing rolling contact prevents surface deterioration as relative movement between the end portion and the gas turbine engine occurs.

19. The combustor assembly of claim 18 wherein said means for providing rolling contact further provides thermal insulation/isolation between the combustor assembly and the gas turbine engine.

* * * * *

UNITED STATES PATENT AND TRADEMARK OFFICE

CERTIFICATE OF CORRECTION

PATENT NO. : 5,457,954

DATED : October 17, 1995

INVENTOR(S) : GARY L. BOYD, ET AL.

It is certified that error appears in the above-identified patent and that said Letters Patent is hereby corrected as shown below:

On title page, item [73] add the following:

--Solar Turbines Incorporated, San Diego, California --

Also add: Attorney, Agent or Firm: Calvin E. Glastetter and

Signed and Sealed this

Twenty-sixth Day of March, 1996

*Attest:*

Bruce Lehman

BRUCE LEHMAN

*Attesting Officer*

*Commissioner of Patents and Trademarks*